US012734424B2

(12) United States Patent
Pearson

(10) Patent No.: US 12,734,424 B2
(45) Date of Patent: Sep. 15, 2026

(54) STEERABLE ROPING TRAINING APPARATUS

(71) Applicant: One More Run LLC, Pima, AZ (US)

(72) Inventor: James A. Pearson, Pima, AZ (US)

(73) Assignee: ONE MORE RUN LLC, Pima, AZ (US)

( * ) Notice: Subject to any disclaimer, the term of this patent is extended or adjusted under 35 U.S.C. 154(b) by 0 days.

(21) Appl. No.: 18/984,096

(22) Filed: Dec. 17, 2024

(65) Prior Publication Data

US 2025/0205575 A1 Jun. 26, 2025

Related U.S. Application Data

(60) Provisional application No. 63/613,477, filed on Dec. 21, 2023.

(51) Int. Cl.
*A63B 69/00* (2006.01)

(52) U.S. Cl.
CPC ..... *A63B 69/0068* (2013.01)

(58) Field of Classification Search
CPC ..... A63B 69/0068; A63H 7/02
USPC ..... 119/839; 446/269.279; 280/1.13, 1.16, 280/1.189, 1.201, 1.202, 1.22, 29, 47.11, 280/47.17, 47.24, 47.34
See application file for complete search history.

(56) References Cited

U.S. PATENT DOCUMENTS 46,705 A * 3/1865 Reynolds ..... A63G 19/00 280/1.204
492,062 A * 2/1893 Snyder ..... A63G 19/00 280/1.204
2,259,987 A * 10/1941 Bailie ..... A63G 19/10 188/24.11
3,514,117 A * 5/1970 Olsen ..... A63G 17/00 280/1.206
4,662,642 A * 5/1987 Archibald ..... A63B 69/0068 273/359
6,405,817 B1 * 6/2002 Huntsberger ..... B62K 9/00 280/47.11
6,945,534 B1 * 9/2005 Lindsey ..... A63B 69/0068 273/359
7,293,775 B1 * 11/2007 Donnelly ..... A01K 15/003 273/359
11,628,344 B2 * 4/2023 Llewellyn ..... A63B 69/0068 119/839
2005/0282128 A1 * 12/2005 Brinkerhoff ..... A63B 69/0068 434/247

(Continued)

*Primary Examiner* — Christopher D Hutchens
*Assistant Examiner* — Nevena Aleksic
(74) *Attorney, Agent, or Firm* — SNELL & WILMER L.L.P.

(57) ABSTRACT

An apparatus for roping practice includes a steering shaft drivable and rotatable by a head model, a steering link drivable by the steering shaft, and a pair of front wheels drivable and rotatable by the steering shaft via the steering link to steer the apparatus. Accordingly, a first user (e.g., a header) can rope the head model and proceed to pull the apparatus along a support or ground surface so that a second user (e.g., a heeler) can subsequently rope hind legs of the apparatus to simulate a live team roping. The first user can apply a lateral force to the head model with the rope to turn the head model which causes the front wheels to turn and thereby steer the apparatus to turn with the first user as the second user prepares to rope the hind legs.

19 Claims, 10 Drawing Sheets

(56) References Cited

U.S. PATENT DOCUMENTS

| | | | | |
|---|---|---|---|---|
| 2014/0261237 | A1* | 9/2014 | Payne | A63B 71/0622 119/839 |
| 2023/0415015 | A1* | 12/2023 | Bach | A63B 69/0068 |

* cited by examiner

STEERABLE ROPING TRAINING APPARATUS

CROSS REFERENCE TO RELATED APPLICATIONS

This application claims priority to, and the benefit of, U.S. Provisional Patent Application Ser. No. 63/613,477, entitled "STEERABLE ROPING TRAINING APPARATUS," filed on Dec. 21, 2023. The '477 Application is hereby incorporated by reference in its entirety for all purposes.

FIELD

The present disclosure relates generally to roping simulators (sometimes referred to as dummies) for enabling users to practice roping cattle or other animals.

BACKGROUND

Known mechanical animal simulator devices enable individuals to practice roping skills without requiring the use of live animals. Such devices attempt to replicate the appearance, movement, and other pertinent characteristics of cattle or other rodeo animals. These devices can, for example, be used in a stationary position and an individual practicing their roping skills attempts to rope the device in situ. These devices can, for example, be used in motion, for example, by pulling the device by hand or by towing the device behind one or more motorized vehicles (such as four-wheelers or ATVs), and individuals wishing to practice roping skills can chase the devices on foot or while mounted on a horse. By attempting to rope the head or leg portions of these devices, individuals can attempt to hone their roping skills.

Team roping involves one team member, the header, roping the head and the other team member, the heeler, roping the hind legs of the steer. Because of the highly competitive nature of this event, a high level of proficiency involving split second timing is required for the team member which ropes the head. The high level of proficiency required can only be developed through a considerable amount of repetitive practice.

Roping simulators possess several advantages. First, they do not require the use of live animals as targets for roping practice. Accordingly, the risk of injury to animals and humans is substantially reduced. Second, because known devices can be dragged or towed behind motorized vehicles (or by hand), the path of such devices can be controlled by the driver of the vehicle (or the individual pulling the device), enabling the individual chasing the device to focus on roping techniques without need to be concerned with unexpected changes of direction. Furthermore, known roping simulators enable as much or as little practice as desired, without regard for the temperament or fatigue of a target animal.

However, known roping simulators are typically limited to use by a single user at a time. That is, roping simulators are meant to be roped by either a header or a heeler, but not at the same time. Moreover, known roping simulators often require an operator (i.e., the individual pulling the device) in addition to the individual(s) honing their roping skills.

Moreover, known roping simulators do not accurately mimic the movement of the bodies of live animals, and as such do not provide as robust a roping simulator as desired. For example, known roping simulators do not accurately simulate the hinging motion between the body and head/shoulders of an animal that is frequently encountered when roping live animals that reach the corner of a run.

Still further, roping simulators are cumbersome to pull and manipulate, particularly by an individual who is attempting to pull the simulator by hand.

There is a need, therefore, for an apparatus for roping training that can easily be pulled by hand, particularly when turning the apparatus, for simulating a live roping.

SUMMARY

In general, one aspect of the subject matter described in this disclosure may be embodied in an apparatus for roping practice. The apparatus can include a frame including a first side member, a second side member, and a cross member extending between and to the first side member and the second side member. The apparatus can include a first spindle pivotally coupled to a first end of the first side member. The apparatus can include a second spindle pivotally coupled to a first end of the second side member. The apparatus can include a steering shaft pivotally coupled to the cross member. The apparatus can include an attachment member coupled to the steering shaft whereby a head model is configured to be mounted to the steering shaft. The apparatus can include a steering link pivotally coupled to the first spindle, the second spindle, and the steering shaft. The steering shaft can be configured to rotate with respect to the frame to cause the first spindle and the second spindle to rotate via the steering link to steer the apparatus.

These and other embodiments may include one or more of the following features. The apparatus can further include the head model mounted to the attachment member and moveable together with the steering shaft with respect to the frame. The apparatus can further include a first spindle tab extending from the first spindle whereby the first spindle is pivotally coupled to the steering link. The apparatus can further include a second spindle tab extending from the second spindle whereby the second spindle is pivotally coupled to the steering link. The apparatus can further include a steering shaft tab extending rearwardly from the steering shaft whereby the steering shaft is pivotally coupled to the steering link. The apparatus can further include a first wheel mounted to the first spindle and a second wheel mounted to the second spindle. The apparatus can further include a third wheel mounted to the third side member, and a fourth wheel mounted to the fourth side member.

The frame can further include a third side member located aft of the first side member and a fourth side member located aft of the second side member. The frame can further include a plate member located vertically from the steering link, the steering shaft is pivotally coupled to the plate member, a second end of the first side member is coupled to the plate member, and a second end of the second side member is coupled to the plate member. The plate member can include a top portion extending laterally between the first side member and the second side member and extending longitudinally between the first side member and the third side member. The plate member can include a first side portion extending downward from the top portion and further extending longitudinally between the first side member and the third side member. The plate member can include a second side portion extending downward from the top portion and further extending longitudinally between the second side member and the fourth side member.

The steering link can include a first pivot point whereby the steering link is pivotally coupled to the first spindle, a second pivot point whereby the steering link is pivotally coupled to the second spindle, and a third pivot point whereby the steering link is pivotally coupled to the steering shaft, the third pivot point is located between the first pivot point and the second pivot point.

In another aspect, the subject matter may be embodied in an apparatus for roping practice, the apparatus including a steering shaft drivable and rotatable by a head model, a steering link drivable by the steering shaft, and a pair of wheels drivable and rotatable by the steering shaft via the steering link to steer the apparatus.

These and other embodiments may include one or more of the following features. The head model can be configured to move laterally in a first direction to drive rotation of the steering shaft in a first rotational direction and the head model is configured to move laterally a second direction to drive rotation of the steering shaft in a second rotational direction. The apparatus can further include a frame including a first side member, a second side member, and a cross member. The steering shaft can extend from the cross member. The first side member can extend from a first end of the cross member, the first side member being at a first non-parallel angle with respect to the steering shaft. The second side member can extend from a second end of the cross member, the second side member being at a second non-parallel angle with respect to the steering shaft. The first side member and the second side member can extend from the cross member toward one another so that a first end of the first side member and a first end of the second side member are closer to one another than a second end of the first side member and a second end of the second side member. The pair of wheels can be configured to pivot in response to lateral movement of the head model. The head model can include a pair of model horns. The steering link can include a first pivot point whereby the steering link is rotatably coupled to a first wheel of the pair of wheels, a second pivot point whereby the steering link is rotatably coupled to a second wheel of the pair of wheels, and a third pivot point whereby the steering link is rotatably coupled to the steering shaft. The apparatus can further include an attachment member mounted to the steering shaft whereby the head model is attached to the steering shaft.

In another aspect, the subject matter may be embodied in a method of steering an apparatus for roping practice. The method includes applying a pulling force to a head model of the apparatus with a rope, the pulling force includes a lateral component, turning the head model in a first lateral direction with the lateral component of the pulling force, driving rotation of a steering shaft with the head model in response to the head model turning, and driving rotation of a first wheel in the first lateral direction with the steering shaft to steer the apparatus in the first lateral direction.

In various embodiments, driving rotation of the first wheel in the first lateral direction with the steering shaft includes translating a steering link from a first position with respect to a frame to a second position with respect to a frame.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Surface shading lines may be used throughout the figures to denote different parts but not necessarily to denote the same or different materials. In some cases, reference coordinates may be specific to each figure.

An apparatus for roping practice of the present disclosure, in accordance with various embodiments, includes a steering shaft drivable and rotatable by a head model, a steering link drivable by the steering shaft, and a pair of front wheels drivable and rotatable by the steering shaft, via the steering link, to steer the apparatus.

In use, a first user (e.g., a header) can rope the head model and proceed to pull the apparatus along a support or ground surface so that a second user (e.g., a heeler) can subsequently rope hind legs of the apparatus to simulate a live team roping. The first user can apply a lateral force to the head model with the rope to turn the head model which causes the front wheels of the apparatus to turn and thereby steer the apparatus to turn with the first user as the second user prepares to rope the hind legs.

Advantageously, the apparatus enhances ease of use and handling for the individual pulling the apparatus as the steerable wheels cause the apparatus to follow the direction of force applied by the first user. In this manner, the apparatus tends to reduce fatigue by the first user. Moreover, the apparatus tends to increase the number of repetitions that an individual can operate the apparatus before becoming fatigued. Still further, the apparatus can be operable by individuals who may otherwise lack sufficient strength to be able to pull and/or turn a roping apparatus that does not have steering capabilities as described herein.

Figure 1A:
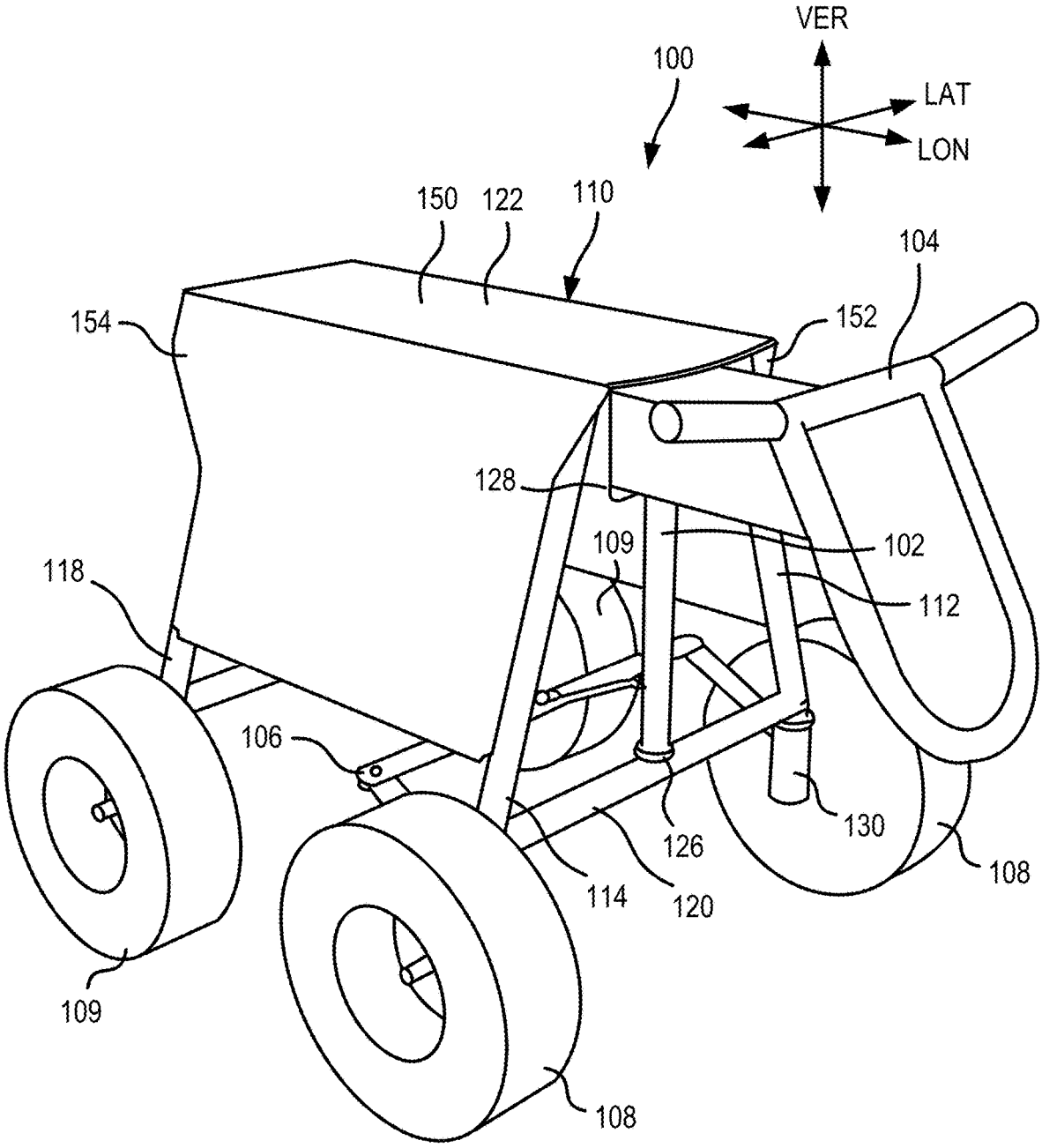
FIG. 1A and FIG. 1B are perspective views of an apparatus for roping practice, in accordance with various embodiments.
Figure 1B:
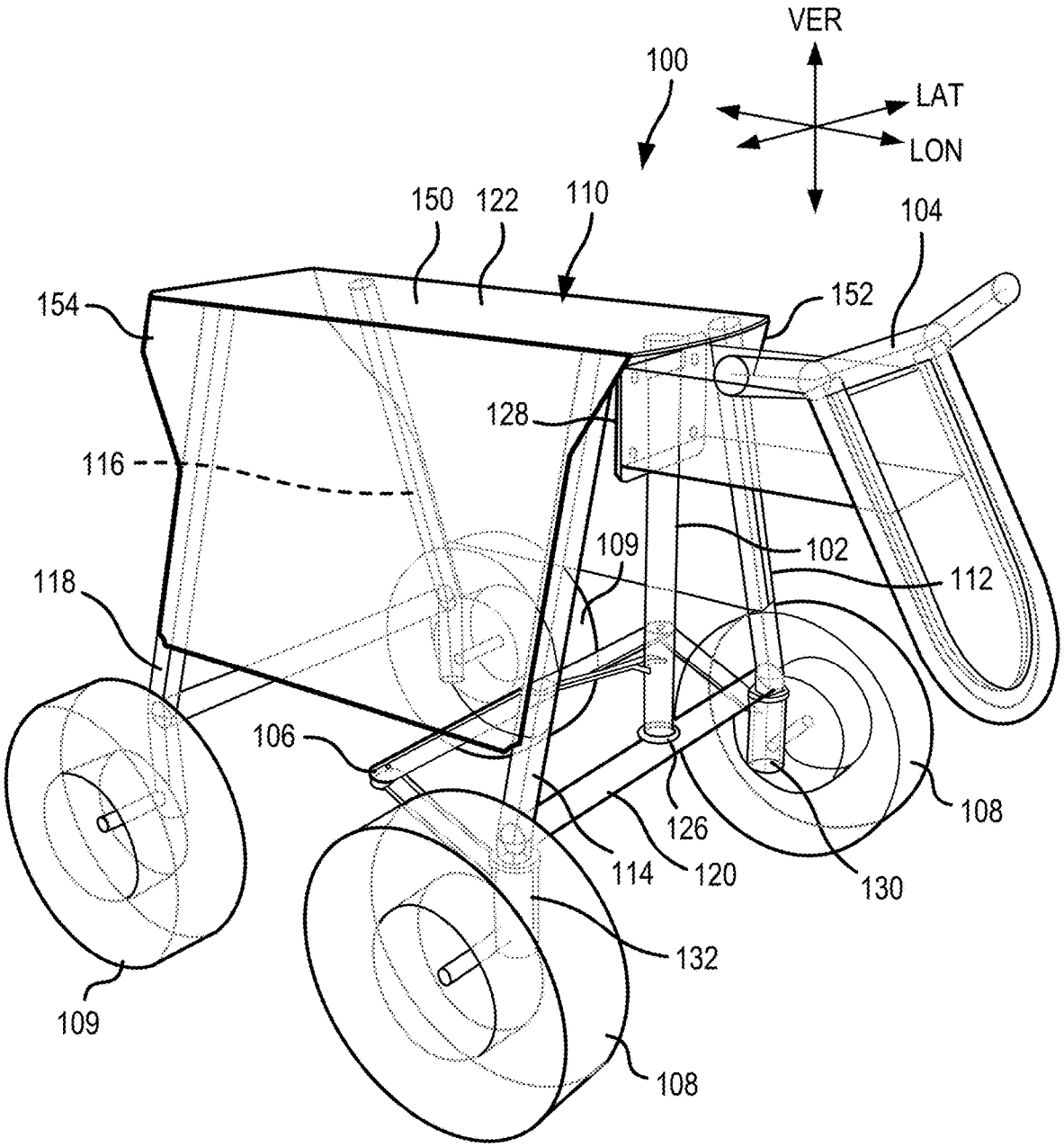

In various embodiments, and with reference to FIG. 1A and FIG. 1B, an apparatus 100 (also referred to as a roping dummy) for roping practice is illustrated, in accordance with various embodiments. The apparatus 100 generally includes a steering shaft 102 drivable and rotatable by a head model 104, a steering link 106 drivable by the steering shaft 102, and a pair of front wheels 108 drivable and rotatable by the steering shaft 102, via the steering link 106, to steer the apparatus 100. In various embodiments, the wheels 108 include pneumatic tires. The wheels 108 can be configured for all terrain use. In various embodiments the wheels 108 can be replaced with skis.

The apparatus 100 further includes a frame 110 generally including a first side member 112, a second side member 114, a third side member 116, a fourth side member 118, a cross member 120, and a plate member 122. The first side member 112, the second side member 114, the third side member 116, the fourth side member 118, and/or the cross member 120 can be made from a tube, a rod, a bar, or the like. The first side member 112, the second side member 114, the third side member 116, the fourth side member 118, and/or the cross member 120 can be made from a metal, a metal alloy, a hard plastic material, or a fiber-reinforced composite material.

The ends (e.g., the top ends) of the first side member 112, the second side member 114, the third side member 116, and the fourth side member 118 can be coupled (e.g., directly) to the plate member 122. For example, the first side member 112, the second side member 114, the third side member 116, and the fourth side member 118 can be attached directly to the plate member 122 via a metal joining process (e.g., a weld, a solder, or a braze), a plurality of fasteners, or any other suitable method of attachment. Wheels can be mounted to opposite ends of the first side member 112, the second side member 114, the third side member 116, and the fourth side member 118. For example, the front wheels 108 can be mounted to the opposite ends (e.g., the bottom ends) of the first and second side members 112, 114 and rear wheels 109 can be mounted to the opposite ends (e.g., the bottom ends) of the third and fourth side members 116, 118. In this manner, the apparatus 100 can be configured to roll along a ground surface.

In various embodiments, the third side member 116 is located laterally from the fourth side member 118. In various embodiments, the third side member 116 is located longitudinally from the first side member 112. In various embodiments, the fourth side member 118 is located longitudinally from the second side member 114. In various embodiments, the second side member 114 is located laterally from the first side member 112.

The steering shaft 102 can be pivotally coupled between the plate member 122 and the cross member 120. The steering shaft 102 can be made from a tube, a rod, a bar, or the like. The steering shaft 102 can be made from a metal, a metal alloy, a hard plastic material, or a fiber-reinforced composite material. The steering shaft 102 can be oriented substantially vertically between the plate member 122 and the cross member 120.

In various embodiments, and with reference to FIG. 3, a first collar 124 can be coupled to the plate member 122 whereby the steering shaft 102 is pivotally coupled to the plate member 122. The first collar 124 can be positioned at an interior surface of the plate member 122. For example, an end of the steering shaft 102 can be positioned in the first collar 124 and the steering shaft 102 can rotate with respect to the first collar 124 and the plate member 122. Stated differently, the first collar 124 can guide rotation of the steering shaft 102. In various embodiments, a second cross member (e.g., a rod, a tube, a bar, a plate, or the like) can be coupled between the upper ends of the first side member 112 and the second side member 114, and the first collar 124 can be mounted directly to the second cross member.

In various embodiments, a second collar 126 can be coupled to the cross member 120 whereby the steering shaft 102 is pivotally coupled to the cross member 120. For example, an end of the steering shaft 102 can be positioned in the second collar 126 and the steering shaft 102 can rotate with respect to the second collar 126 and the cross member 120. Stated differently, the second collar 126 can guide rotation of the steering shaft 102. Various methods of pivotally coupling the ends of the steering shaft 102 to the plate member 122 and/or the cross member 120 can be utilized without departing from the scope of the present disclosure. For example, a spindle can be coupled to the plate member 122 and/or the cross member 120 which can extend into an open end of the steering shaft 102 to guide rotation of the steering shaft 102, in accordance with various embodiments.

An attachment member 128 can be coupled to the steering shaft 102 whereby the head model 104 is configured to be mounted to the steering shaft 102. The attachment member 128 can be a plate with a plurality of holes configured to receive fasteners whereby the head model 104 is connected to the attachment member 128. The attachment member 128 can be welded to the steering shaft 102, in various embodiments. The head model 104 can be removably mounted to the attachment member 128. The head model 104 can be moveable together with the steering shaft 102 with respect to the frame 110. Stated differently, the head model 104 can rotate together with the steering shaft 102. With momentary reference to FIG. 3A, the head model 104 can be sized and shaped to approximate the size and shape of a live steer head or head of another roping animal. The head model can resemble an appearance of a head of the roping animal. For example, the head model 104 can include two model horn portions 160 and a model muzzle portion 162. The head model 104 can further include a neck portion 164 whereby the head model 104 is connected to the attachment member 128. In various embodiments, the head model 104 is attached to the attachment member 128 via a plurality of fasteners, such as bolts for example.

Figure 2:
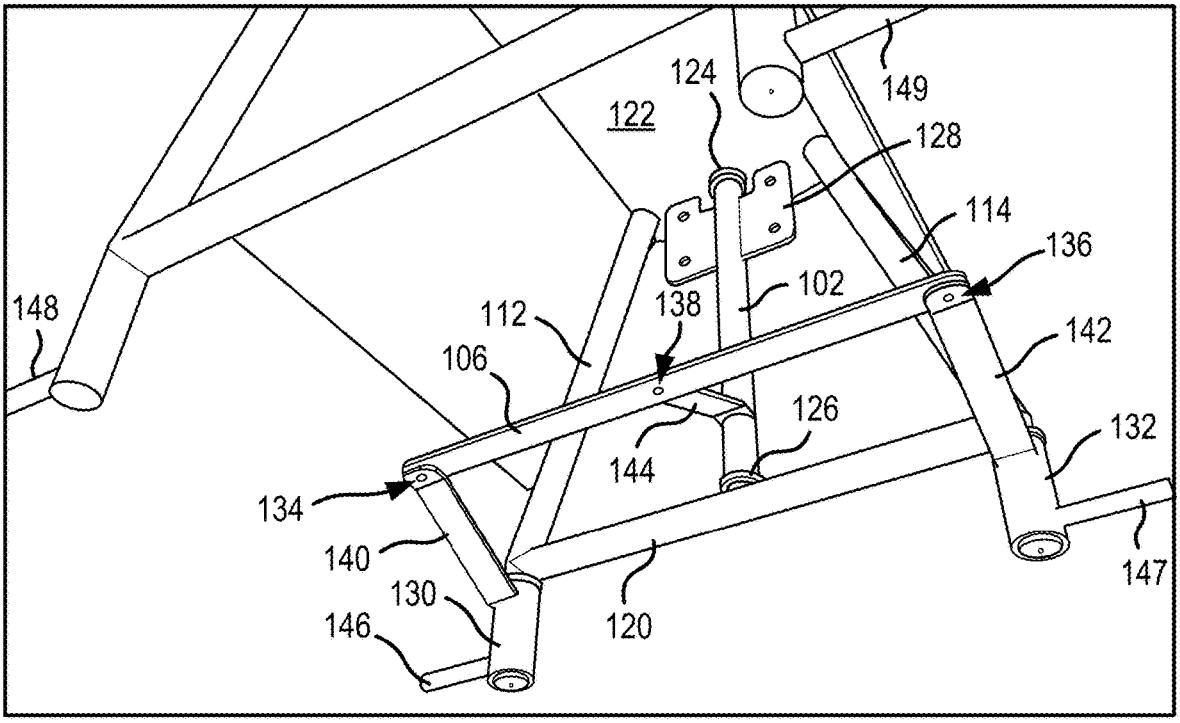
FIG. 2 is a bottom perspective view of a portion of the apparatus of FIG. 1A with the wheels and the head model omitted for ease of illustration, in accordance with various embodiments.

In various embodiments, and with reference again to FIG. 2, the apparatus 100 further includes a first spindle 130 pivotally mounted to the first side member 112 and a second spindle 132 pivotally mounted to the second side member 114. The first spindle 130 can be mounted to an end (e.g., a bottom end) of the first side member 112. The second spindle 132 can be mounted to an end (e.g., a bottom end) of the second side member 114. One of the wheels 108 can be rotatably mounted to the first spindle 130 and the other of the wheels 108 can be rotatably mounted to the second spindle 132. The first and second spindles 130, 132 can be driven by the steering link 106 to rotate about the ends of the side members 112, 114, respectively. The axis of rotation of each of the first and second spindles 130, 132 can be oriented substantially vertically. The axis of rotation of the wheels 108 can be oriented substantially horizontally (e.g., laterally when the head model 104 is in a straightforward facing position).

The steering link 106 can be pivotally coupled to the steering shaft 102, the first spindle 130, and the second spindle 132. The steering link 106 can be driven by the steering shaft 102. The steering shaft 102 can be configured to rotate with respect to the frame 110 to cause the first spindle 130 and the second spindle 132 to rotate via the steering link 106 to steer the apparatus 100. In various embodiments, the steering link 106 includes a first pivot point 134 whereby the steering link 106 is pivotally coupled to the first spindle 130. The steering link 106 can further include a second pivot point 136 whereby the steering link 106 is pivotally coupled to the second spindle 132. The steering link 106 can further include a third pivot point 138 whereby the steering link 106 is pivotally coupled to the steering shaft 102. The third pivot point 138 can be located between the first pivot point 134 and the second pivot point 136. The first pivot point 134 can be located at a first end of the steering link 106. The second pivot point 136 can be located at a second end of the steering link 106, opposite the first end.

In various embodiments, a first spindle tab 140 extends from the first spindle 130 whereby the first spindle 130 is pivotally coupled to the steering link 106. A second spindle tab 142 can similarly extend from the second spindle 132 whereby the second spindle 132 is pivotally coupled to the steering link 106. The spindle tabs 140, 142 can extend rearwardly from the first and second spindles 130, 132, respectively. The spindle tabs 140, 142 can extend longitudinally from the first and second spindles 130, 132, respectively. A steering shaft tab 144 can extend from the steering shaft 102 whereby the steering shaft 102 is pivotally coupled to the steering link 106. The steering shaft tab 144 can extend rearwardly from the steering shaft 102. The steering shaft tab 144 can extend longitudinally from the steering shaft 102.

In various embodiments, a first wheel axle 146 extends from the first spindle 130. The first wheel axle 146 can extend laterally outward from the first spindle 130. The first wheel 108 can be pivotally mounted to the first spindle 130 via the first wheel axle 146. In various embodiments, a second wheel axle 147 extends from the second spindle 132. The second wheel axle 147 can extend laterally outward from the second spindle 132. The second wheel 108 can be pivotally mounted to the second spindle 132 via the second wheel axle 147. In various embodiments, a third wheel axle 148 extends from the third side member 116. The third wheel axle 148 can extend laterally outward from the third side member 116. The third wheel 109 can be pivotally mounted to the third side member 116 via the third wheel axle 148. In various embodiments, a fourth wheel axle 149 extends from the fourth side member 118. The fourth wheel axle 149 can extend laterally outward from the fourth side member 118. The fourth wheel 109 can be pivotally mounted to the fourth side member 118 via the fourth wheel axle 149.

In various embodiments, the plate member 122 is located vertically from the steering link 106. The plate member 122 can include a top portion 150 extending laterally between the first side member 112 and the second side member 114 and extending longitudinally between the first side member 112 and the third side member 116. The plate member 122 can further include a first side portion 152 extending downward from the top portion 150 and further extending longitudinally between the first side member 112 and the third side member 116. The plate member 122 can further include a second side portion 154 extending downward from the top portion 150 and further extending longitudinally between the second side member 114 and the fourth side member 118.

Figure 3A:
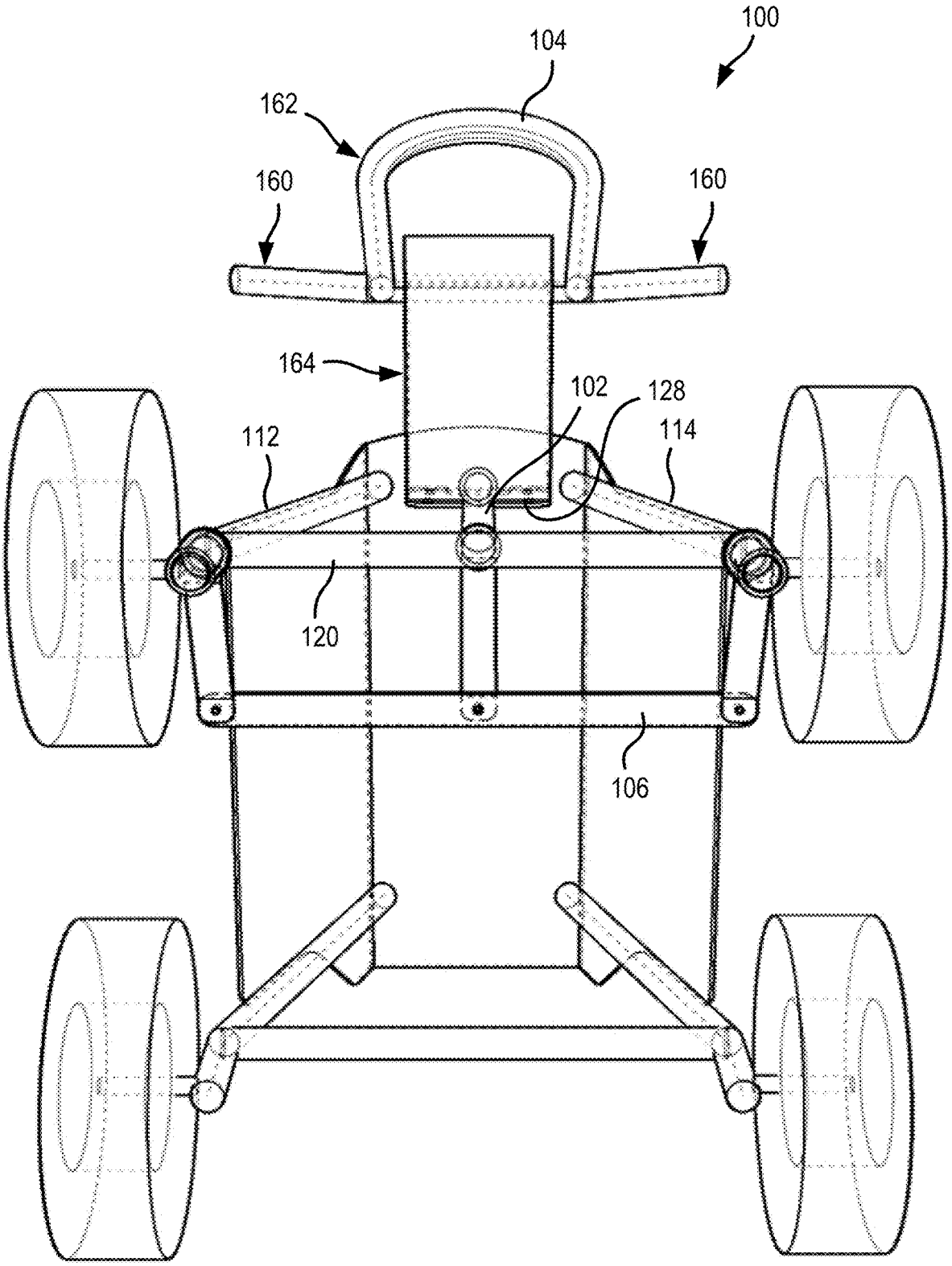
FIG. 3A, FIG. 3B, and FIG. 3C are bottom views of an apparatus for roping practice with the head model in a straight position, a first turning position, and a second turning position, respectively, in accordance with various embodiments.
Figure 3B:
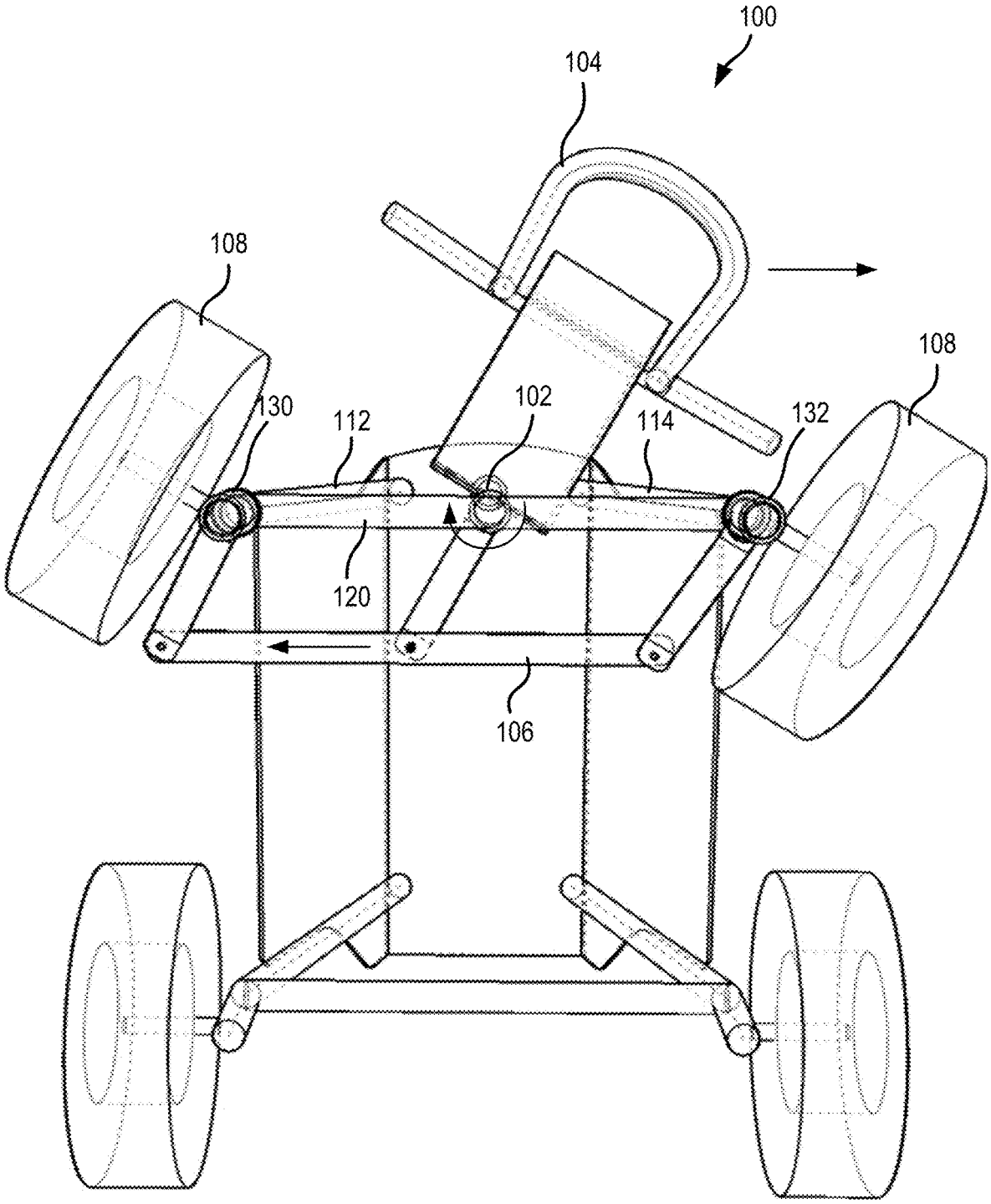
Figure 3C:
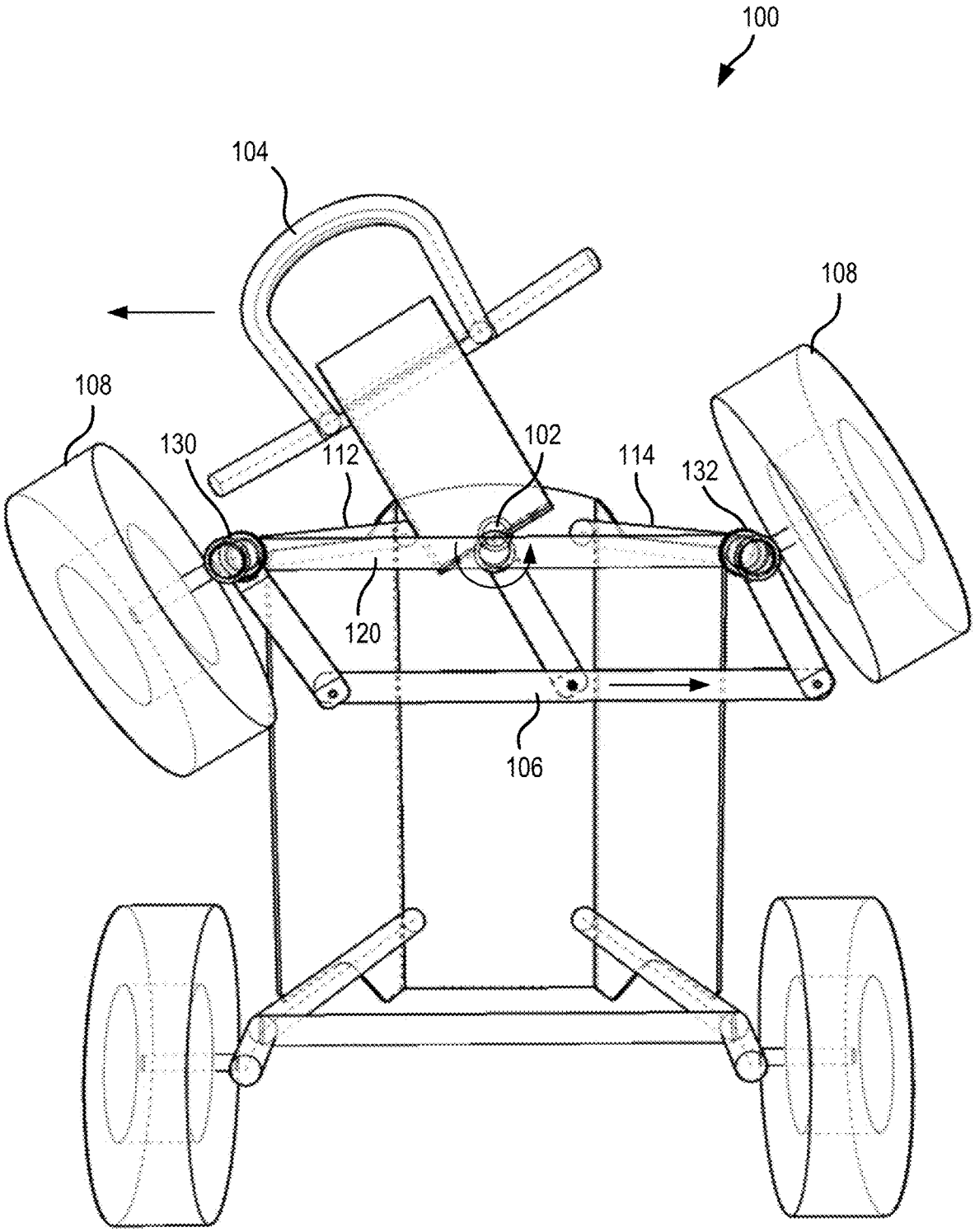

FIG. 3A, FIG. 3B, and FIG. 3C are bottom views of the apparatus 100 with the head model 104 in a straight position, a first turning position (e.g., a left-turning position), and a second turning position (e.g., a right-turning position), respectively, in accordance with various embodiments. FIG. 3A may represent a straight forward direction. With momentary reference to FIG. 3B, the head model 104 can be configured to move laterally in a first direction to drive rotation of the steering shaft 102 in a first rotational direction. In response to driving the steering shaft 102 to rotate in the first rotational direction, the steering link 106 can be translated in a second direction, opposite the first direction, to thereby drive rotation of the first and second spindles 130, 132 and the wheels 108 mounted thereon. Accordingly, the apparatus 100 can be steered in the first direction by pivoting the head model 104 in the first direction.

With momentary reference to FIG. 3C, the head model 104 can be configured to move laterally in a second direction to drive rotation of the steering shaft 102 in a second rotational direction. In response to driving the steering shaft 102 to rotate in the second rotational direction, the steering link 106 can be translated in the first direction, opposite the second direction, to thereby drive rotation of the first and second spindles 130, 132 and the wheels 108 mounted thereon. Accordingly, the apparatus 100 can be steered in the second direction by pivoting the head model 104 in the second direction. In this manner, the pair of wheels 108 is configured to pivot in response to lateral movement of the head model 104.

Figure 4:
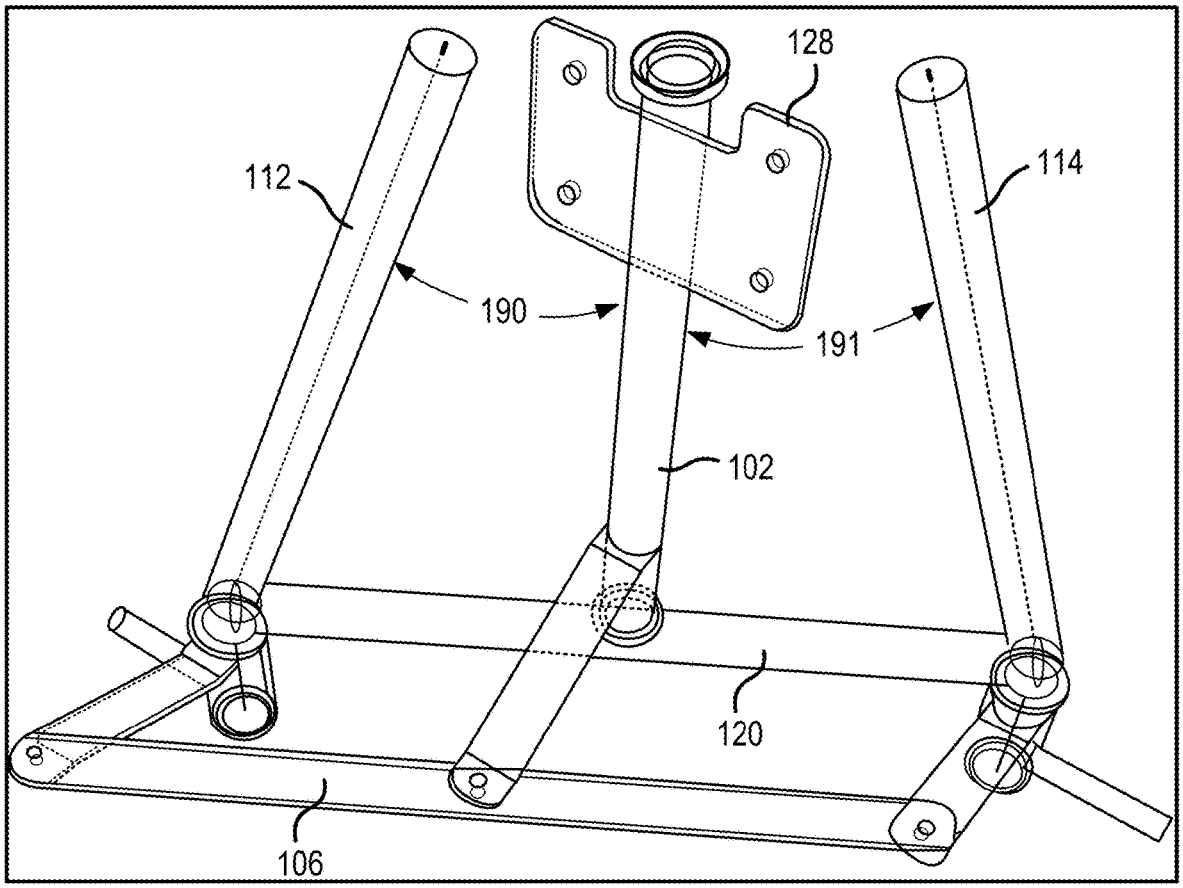
FIG. 4 is a perspective view of steering components for an apparatus for roping practice, in accordance with various embodiments.

With momentary reference to FIG. 4, a perspective view of the steering components of the apparatus 100 is provided, in accordance with various embodiments. In the steering shaft 102 extends from the cross member 120. The various embodiments, first side member 112 can extend from a first end of the cross member 120. The first side member 112 can be oriented at a first non-parallel angle 190 with respect to the steering shaft 102. The second side member 114 can extend from a second end of the cross member 120. The second side member 114 can be oriented at a second non-parallel angle 191 with respect to the steering shaft 102. The first side member 112 and the second side member 114 can extend toward one another so that the upper ends of the first and second side members 112, 114 are closer together than the lower ends of the first and second side members 112, 114. Stated differently, the first and second side members 112, 114 may be angled inward toward the steering shaft 102. In this manner, the lower portion of the apparatus 100 can be wider than an upper portion of the apparatus 100 which can increase the stability of the apparatus 100 and prevent the apparatus 100 from tipping over during use.

Figure 5:
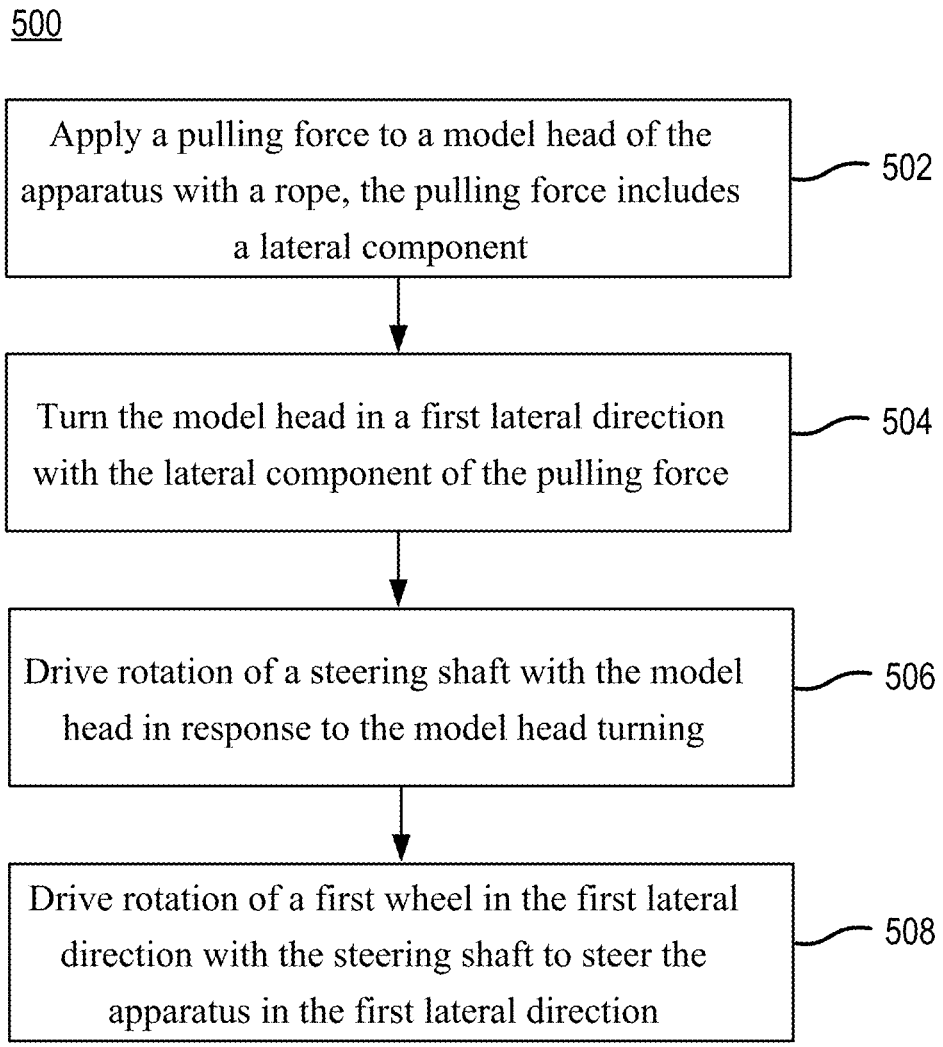
FIG. 5 is a flow chart for a method of steering an apparatus for roping practice, in accordance with various embodiments.
Figure 6:
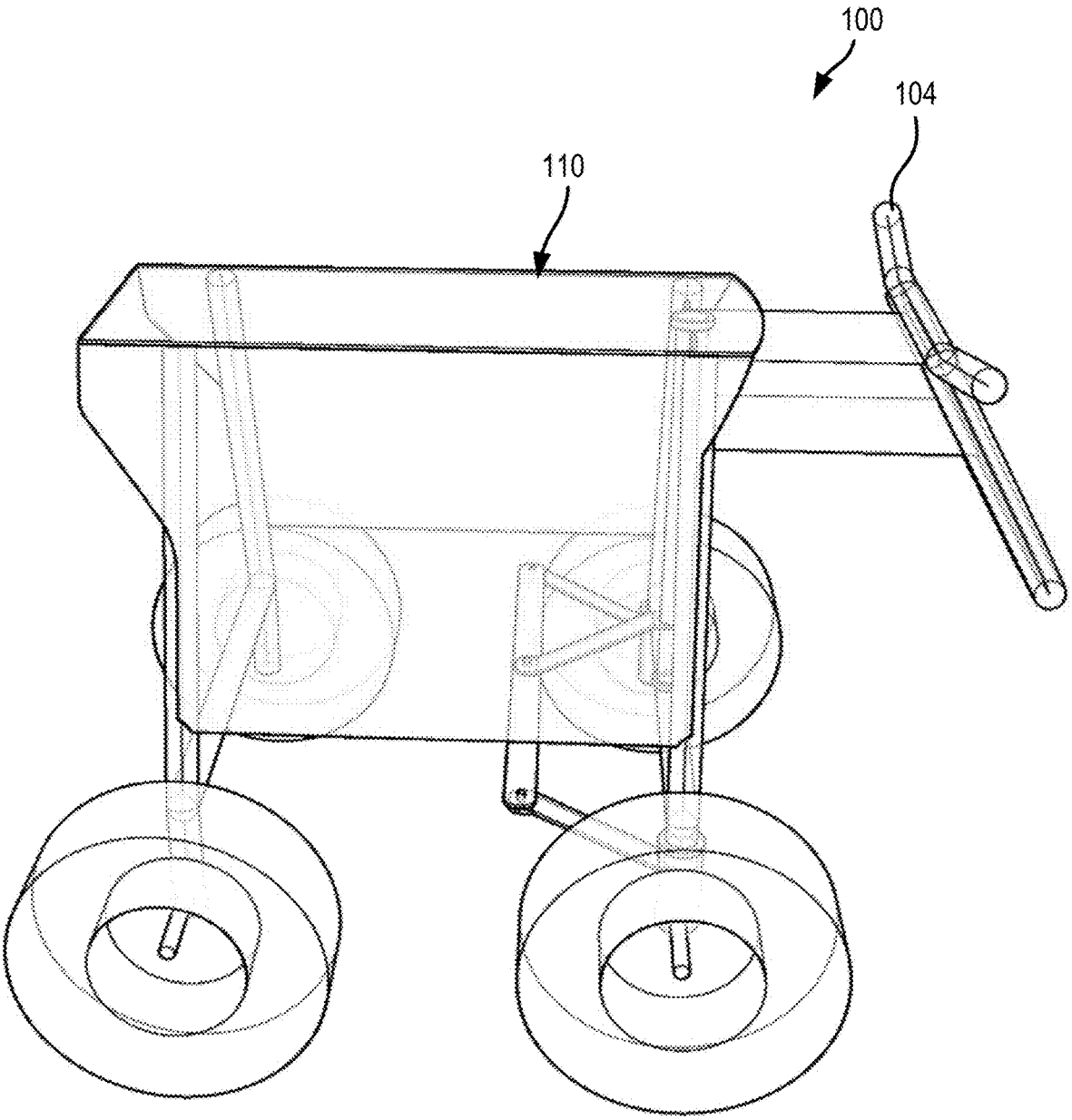
FIG. 6 is a side view of an apparatus for roping practice, in accordance with various embodiments.
Figure 7:
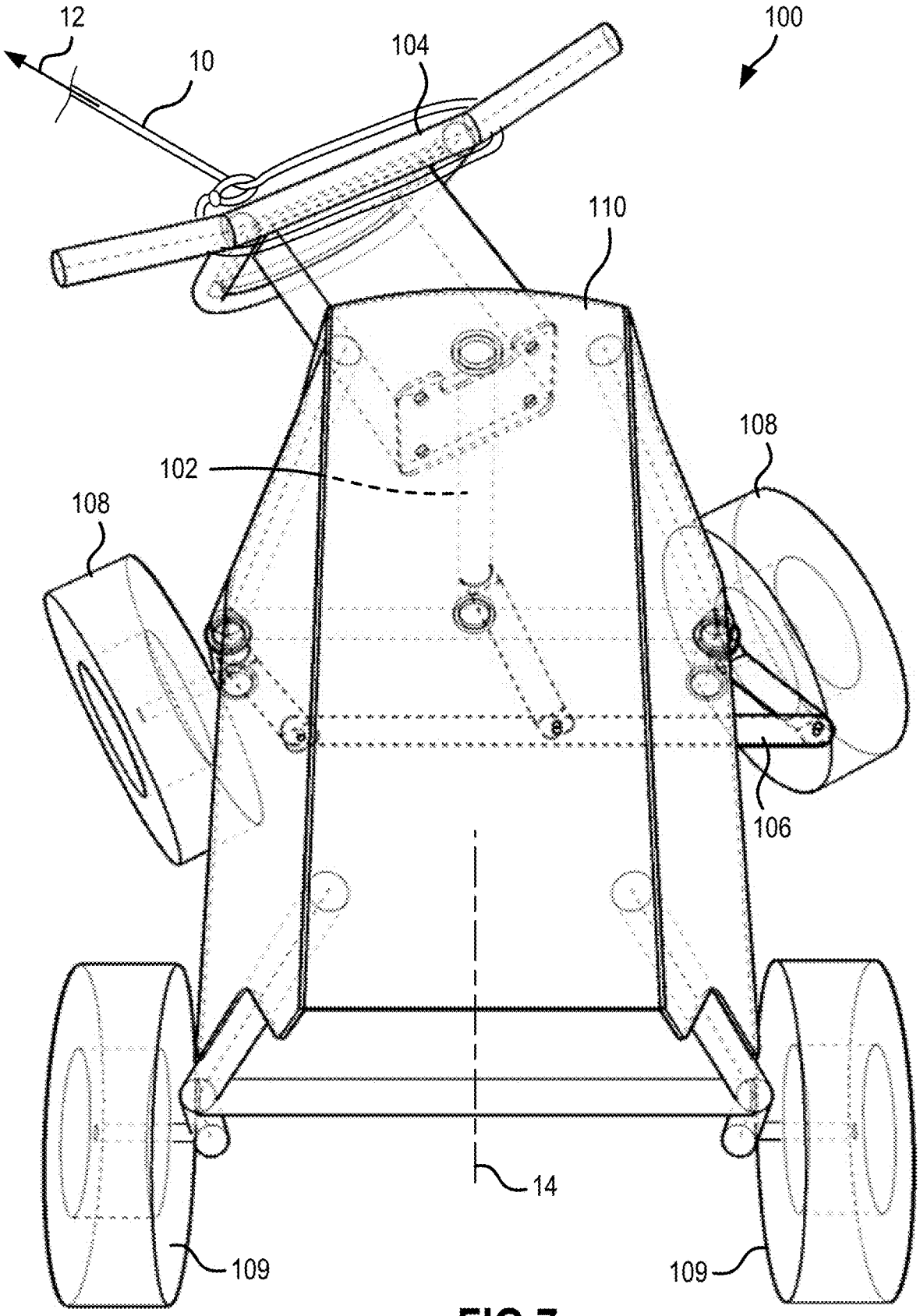
FIG. 7 is a top view of an apparatus for roping practice being pulled laterally by a rope, in accordance with various embodiments.

In various embodiments, referring to FIG. 5, a method 500 of steering an apparatus for roping practice is provided. The method 500 is described below with respect to FIG. 6 and FIG. 7. The method 500, however, is not limited in this regard and can be used in connection with any suitable roping apparatus.

In use, the apparatus 100 can be stationary with the head model 104 oriented straight (e.g., see FIG. 6) or with the head model 104 oriented in any desirable position, for example turned to a side (e.g., see FIG. 3B and FIG. 3C). A first user can rope the head model 104 of the apparatus 100. In step 502, the user can apply a pulling force (illustrated by arrow 12) to the head model 104 with a rope 10. The pulling force includes a lateral component (i.e., a component in a direction perpendicular to the longitudinal axis 14 of the apparatus 100). In step 504, the method can include turning the head model in a first lateral direction (i.e., to the left in FIG. 7) with the lateral component of the pulling force 12. In step 506, the method can include driving rotation of a steering shaft 102 with the head model 104 in response to the head model 104 turning. Stated differently, the steering shaft 102 can rotate together with the head model 104 about a central axis of the steering shaft 102. In step 508, the method can include driving rotation of wheels 108 in the first lateral direction with the steering shaft 102 to steer the apparatus 100 in the first lateral direction. Step 508 can include translating the steering link 106 from a first position (e.g., see FIG. 3A) with respect to the frame 110 to a second position (e.g., see FIG. 3B and FIG. 7) with respect to the frame 110.

The first user can continue to pull the apparatus 100 to cause the apparatus 100 to turn and move forward (i.e., the wheels 108, 109 roll along the ground surface) while a second user can follow the apparatus 100 and rope hind leg (not shown) of the apparatus 100 to practice heeling. In this manner, two individuals can utilize the apparatus 100 simultaneously in a simulated team roping event to practice their roping skills. Moreover, because the wheels 108 are steerable and turn in the direction of the first user (e.g., the header), the apparatus 100 is more easily manipulated and handled.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is intended to invoke 35 U.S.C. § 112 (f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An apparatus for roping practice, comprising:

a frame including a first side member, a second side member, and a cross member extending between and to the first side member and the second side member;

a first spindle pivotally coupled to a first end of the first side member;

a second spindle pivotally coupled to a first end of the second side member;

a steering shaft pivotally coupled to the cross member;

an attachment member coupled to the steering shaft whereby a head model is configured to be mounted to the steering shaft; and a steering link pivotally coupled to the first spindle, the second spindle, and the steering shaft, and the steering shaft is configured to rotate with respect to the frame to cause the first spindle and the second spindle to rotate via the steering link to steer the apparatus.

2. The apparatus of claim 1, further comprising:

a first spindle tab extending from the first spindle whereby the first spindle is pivotally coupled to the steering link; and a second spindle tab extending from the second spindle whereby the second spindle is pivotally coupled to the steering link.

3. The apparatus of claim 2, further comprising a steering shaft tab extending rearwardly from the steering shaft whereby the steering shaft is pivotally coupled to the steering link.

4. The apparatus of claim 1, further comprising a first wheel ground-engaging member mounted to the first spindle and a second ground-engaging member mounted to the second spindle.

5. The apparatus of claim 1, wherein the frame further includes a third side member located aft of the first side member and a fourth side member located aft of the second side member.

6. The apparatus of claim 5, further comprising:

a first ground-engaging member mounted to the first spindle;

a second ground-engaging member mounted to the second spindle;

a third ground-engaging member mounted to the third side member; and a fourth ground-engaging member mounted to the fourth side member.

7. The apparatus of claim 5, wherein the frame further includes a plate member located vertically from the steering link, the steering shaft is pivotally coupled to the plate member, a second end of the first side member is coupled to the plate member, and a second end of the second side member is coupled to the plate member.

8. The apparatus of claim 7, wherein the plate member includes:

a top portion extending laterally between the first side member and the second side member and extending longitudinally between the first side member and the third side member;

a first side portion extending downward from the top portion and further extending longitudinally between the first side member and the third side member; and a second side portion extending downward from the top portion and further extending longitudinally between the second side member and the fourth side member.

9. The apparatus of claim 1, wherein the steering link includes:

a first pivot point whereby the steering link is pivotally coupled to the first spindle;

a second pivot point whereby the steering link is pivotally coupled to the second spindle; and a third pivot point whereby the steering link is pivotally coupled to the steering shaft, the third pivot point is located between the first pivot point and the second pivot point.

10. The apparatus of claim 1, further comprising the head model mounted to the attachment member and moveable together with the steering shaft with respect to the frame.

11. An apparatus for roping practice, comprising:

a steering shaft drivable and rotatable by a head model;

a steering link drivable by the steering shaft; and a pair of ground-engaging members drivable and rotatable by the steering shaft via the steering link to steer the apparatus; and a frame including a first side member, a second side member, and a cross member, the steering shaft extends from the cross member, the first side member extends from a first end of the cross member, the first side member is at a first non-parallel angle with respect to the steering shaft, and the second side member extends from a second end of the cross member, the second side member is at a second non-parallel angle with respect to the steering shaft, wherein the first side member and the second side member extend from the cross member toward one another so that a first end of the first side member and a first end of the second side member are closer to one another than a second end of the first side member and a second end of the second side member.

12. The apparatus of claim 11, wherein the head model is configured to move laterally in a first direction to drive rotation of the steering shaft in a first rotational direction and the head model is configured to move laterally a second direction to drive rotation of the steering shaft in a second rotational direction.

13. The apparatus of claim 11, wherein the pair of ground-engaging members is configured to pivot in response to lateral movement of the head model.

14. The apparatus of claim 11, wherein the head model includes a pair of model horns.

15. The apparatus of claim 11, wherein the steering link includes a first pivot point whereby the steering link is rotatably coupled to a first ground-engaging member of the pair of ground-engaging members, a second pivot point whereby the steering link is rotatably coupled to a second ground-engaging member of the pair of ground-engaging members, and a third pivot point whereby the steering link is rotatably coupled to the steering shaft.

16. The apparatus of claim 11, further comprising an attachment member mounted to the steering shaft whereby the head model is attached to the steering shaft.

17. A method of steering an apparatus for roping practice, the apparatus including:

a frame including a first side member, a second side member, and a cross member extending between and to the first side member and the second side member;

a first spindle pivotally coupled to a first end of the first side member;

a second spindle pivotally coupled to a first end of the second side member;

a steering shaft pivotally coupled to the cross member;

an attachment member coupled to the steering shaft whereby a head model is configured to be mounted to the steering shaft; and a steering link pivotally coupled to the first spindle, the second spindle, and the steering shaft, and the steering shaft is configured to rotate with respect to the frame to cause the first spindle and the second spindle to rotate via the steering link to steer the apparatus;

wherein the method comprises:

applying a pulling force to the head model of the apparatus with a rope, the pulling force includes a lateral component;

turning the head model in a first lateral direction with the lateral component of the pulling force;

driving rotation of the steering shaft with the head model in response to the head model turning; and driving rotation of the first spindle in the first lateral direction with the steering shaft to steer the apparatus in the first lateral direction, including translating the steering link from a first position with respect to the frame to a second position with respect to the frame.

18. The apparatus of claim 1, wherein the first end of the first side member is vertically spaced from an opposite, second end of the first side member.

19. The apparatus of claim 1, wherein the crossmember extends generally transversely between the first side member and the second side member and has a first end transversely spaced from an opposite, second end.

* * * * *